US011051100B1

(12) United States Patent
D'Ascanio et al.

(10) Patent No.: US 11,051,100 B1
(45) Date of Patent: Jun. 29, 2021

(54) ABOVE AND UNDER THE WATER SPEAKER

(71) Applicants: Franco L D'Ascanio, Key Colony Beach, FL (US); Franco C D'Ascanio, Key Colony Beach, FL (US); Sean P Snowden, Marathon, FL (US); Harold M Zimmermann, Riverton, NJ (US)

(72) Inventors: Franco L D'Ascanio, Key Colony Beach, FL (US); Franco C D'Ascanio, Key Colony Beach, FL (US); Sean P Snowden, Marathon, FL (US); Harold M Zimmermann, Riverton, NJ (US)

(73) Assignee: COASTAL SOURCE, LLC, Marathon, FL (US)

( * ) Notice: Subject to any disclaimer, the term of this patent is extended or adjusted under 35 U.S.C. 154(b) by 0 days.

(21) Appl. No.: 17/159,665

(22) Filed: Jan. 27, 2021

Related U.S. Application Data

(60) Provisional application No. 62/966,622, filed on Jan. 28, 2020.

(51) Int. Cl.
*H04R 1/44* (2006.01)
*H04R 1/02* (2006.01)

(52) U.S. Cl.
CPC ..... *H04R 1/44* (2013.01); *H04R 1/023* (2013.01); *H04R 1/026* (2013.01)

(58) Field of Classification Search
CPC ..... H04R 1/44; H04R 1/023; H04R 1/026
See application file for complete search history.

(56) References Cited

U.S. PATENT DOCUMENTS 3,150,345 A * 9/1964 Freeman ..... H04B 11/00 367/132
7,218,746 B2 * 5/2007 Schmidt ..... H04R 1/028 381/334

* cited by examiner

*Primary Examiner* — Andrew L Sniezek
(74) *Attorney, Agent, or Firm* — Stuart M. Goldstein

(57) ABSTRACT

A fully integrated, smart, under/over water speaker system has two dedicated transducers which deliver sound directly to underwater and above water environments. A transducer which is optimized to couple sound to the air is positioned on top of a speaker and another transducer optimized to couple sound below the water is located on the bottom of the speaker. The speaker is watertight and waterproof and is completely sealed and self-righting when thrown into the water. It is wireless, has built-in integrated amplification, communication sensors and signal data processing, and is battery powered. Music streaming can be provided via wireless methods such as Bluetooth or Wi-Fi, along with solid state storage. Integrated RGV lighting which beats to the music can be optional both above and under the water.

8 Claims, 2 Drawing Sheets

ABOVE AND UNDER THE WATER SPEAKER

RELATED APPLICATION

This application claims the benefit of provisional application 62/966,622, filed on Jan. 28, 2020.

FIELD OF THE INVENTION

The present invention relates to a unique speaker which provides sound both above and below the water's surface.

BACKGROUND OF THE INVENTION

Mobile wireless audio devices that are designed to play music are very popular. Many such devices exist that are water resistant, but none are submersible and capable of transmitting sound underwater. The sensation of listening to music both above and below the water's surface and having the music follow as one swims or dives is a unique and satisfying experience.

However, reproducing sound in the air is very different from reproducing sound under the water. Most speakers produce sound in air in a directional manner, whereas sound underwater is naturally omni-directional. The impedance (resistance) to sound production underwater is very high, as opposed to the resistance to sound production in air, which is very low. Different solutions are required for each. The transmission of sound from above the water to below the water or vice versa is extremely low and no speaker or speaker system exists which successfully provides a seamless transition of clear sound from above to below the water's surface.

SUMMARY OF THE INVENTION

It is thus the object of the present invention to provide a speaker system incorporating technology which efficiently and effectively creates omni-directional sound above and below the water's surface, along with technology which makes it practical and useful in varied applications and environments.

These and other objects are accomplished by the present invention, a fully integrated, smart, under/over water surface speaker system having two dedicated transducers which deliver sound directly to underwater and above water environments. A transducer which is optimized to couple sound to the air is positioned on top of a speaker and another transducer optimized to couple sound below the water is located on the bottom of the speaker. The speaker is watertight and waterproof and is completely sealed and self-righting when thrown into the water. It is wireless, has built-in integrated amplification, communication sensors and signal data processing, and is battery powered. Music streaming can be provided via wireless methods such as Bluetooth or Wi-Fi, along with solid state storage. Integrated RGV lighting which beats to the music can be optional both above and under the water.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
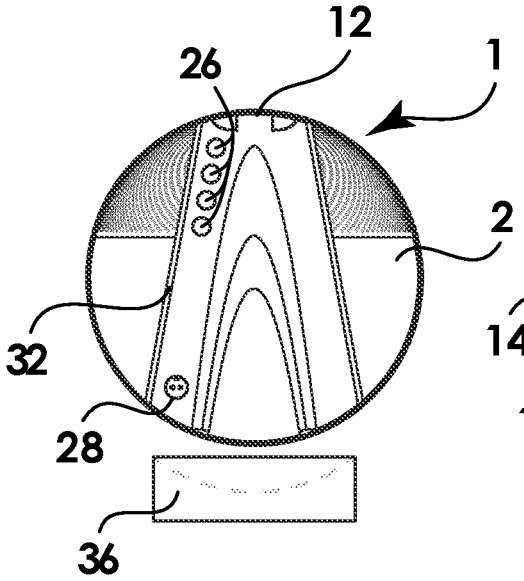
FIG. 1 is an elevation view of the speaker system of the present invention.
Figure 2:
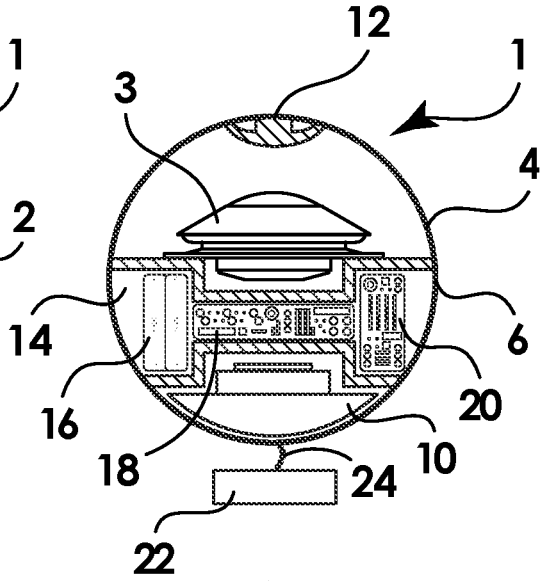
FIG. 2 is a cross-sectional view of the housing of the speaker system of the present invention.
Figure 3:
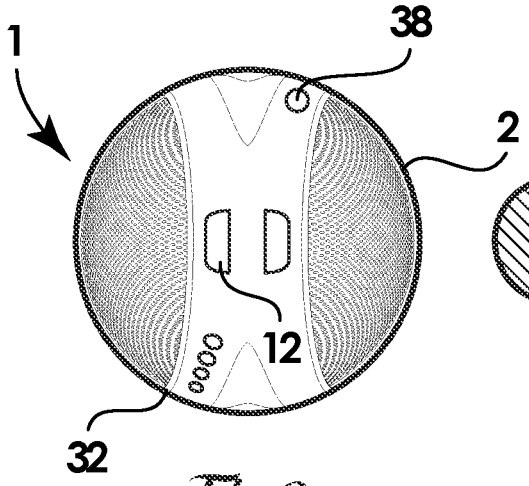
FIG. 3 is a top view of the speaker system of the present invention.
Figure 4:
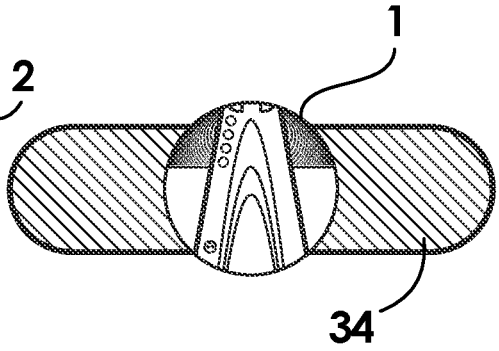
FIG. 4 is an elevation view of the speaker system of the present invention with mounted float ring.
Figure 5:
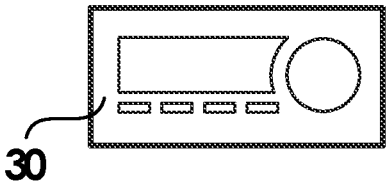
FIG. 5 is a view of the remote electronic component used with the present invention.
Figure 6:
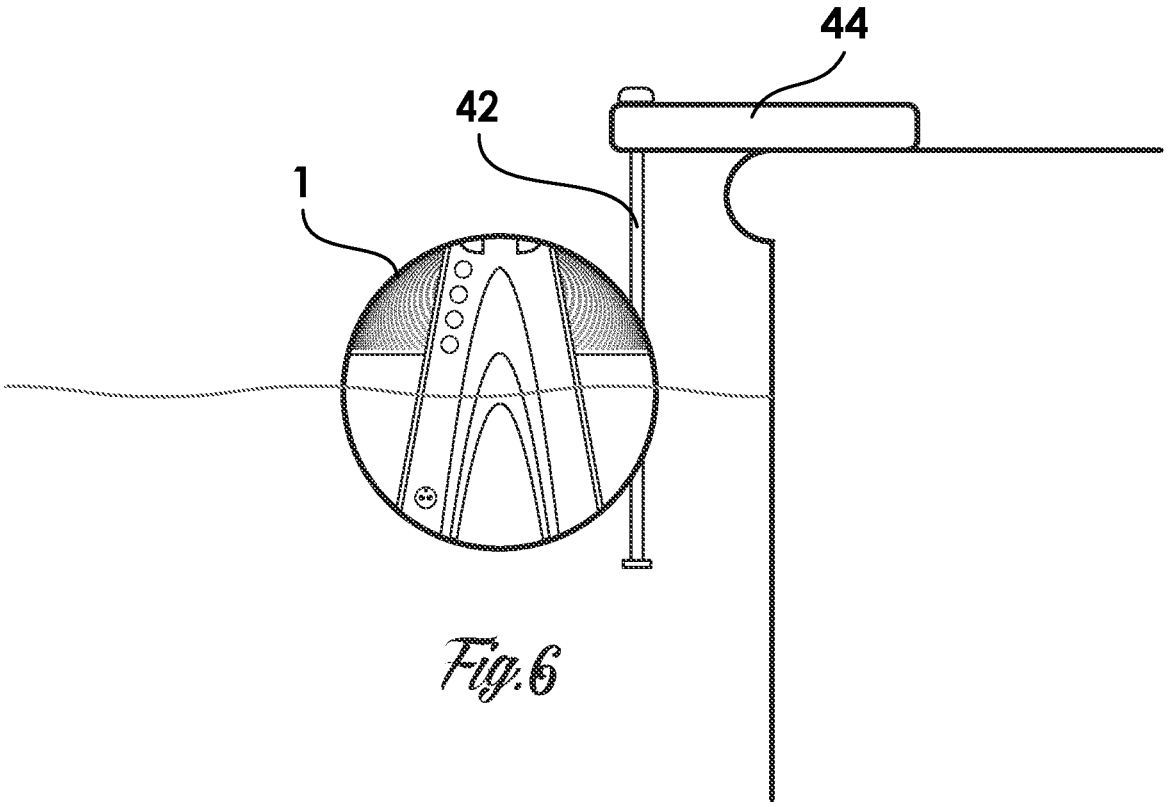
FIG. 6 is a view of the speaker system of the present invention floating in water, showing a side mount self-adjusting water height pool mount.
Figure 7:
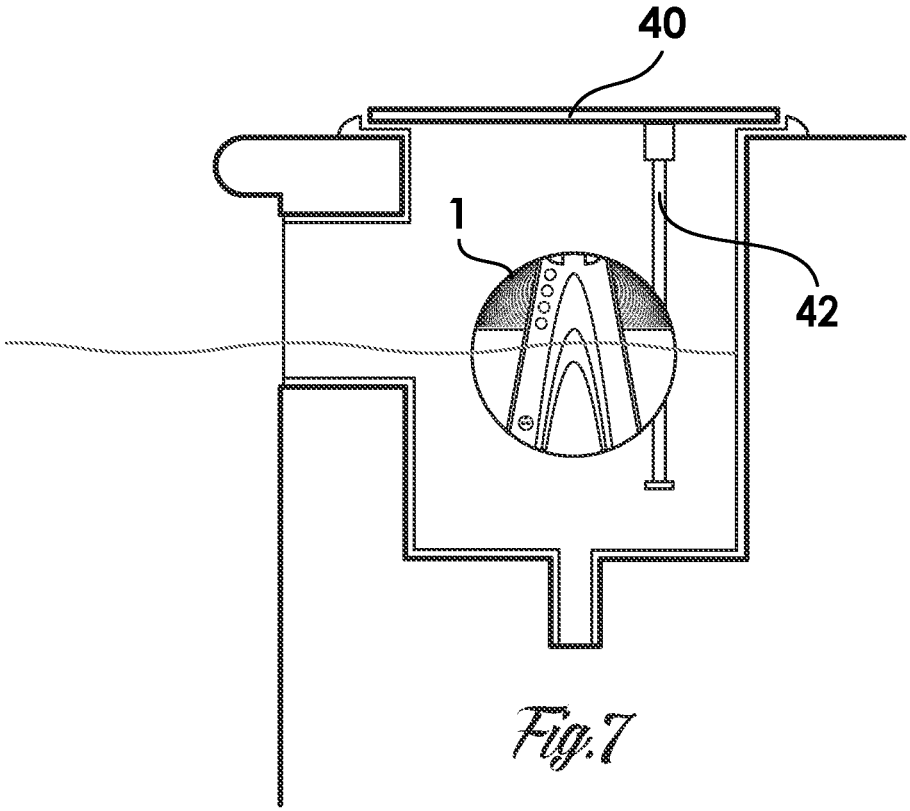
FIG. 7 is a view of the speaker system of the present invention in water, in conjunction with a flush mount pool skimmer adapter with self-adjusting water height rod.

With specific reference to FIGS. 1-4, speaker 1 of the present invention comprises watertight, waterproof, sealed housing 2 having top section 4 and bottom section 6. Housing 2 has a silicone rubber skin to reduce impact forces. Upper dedicated transducer 8 is located within top section 4 and lower dedicated transducer 10 is located within bottom section 6. Dual transducers 8 and 10 deliver sound directly to their respective environments via omni directional, self cleaning/self dome transducers. Top transducer 8 is optimized to couple sound to the air. Lower transducer 10 is optimized to couple sound to water when in contact with the water and is optimized to couple to the air when out of the water. The opposing forces of the transducers cancel all vibration and motion.

Wave guide 12 distributes the sound from upper transducer 8, 360 degrees to create omni-directional sound. The wave guide also serves as a carrying handle for speaker 1.

Component chamber 14 is IP-68 rated. It is located between upper transducers and lower transducer 10 within housing 2. Chamber 14 is completely sealed to maintain and protect rechargeable battery 16, speaker electronics 18, and speaker sensors 20.

Self retracting, weighted tethered anchoring pad 22 is optionally located at the bottom of housing 2 of speaker 1. Tether 24, either floating or sinking type wire, connects pad 22 to housing 2 when pad 22 is utilized and it is deployed to maintain the speaker is one location and secured in open bodies of water. The flat bottom of pad 22 eliminates rolling when above water.

Speaker command buttons 26 are provided to manually operate and control speaker functions such as on/off modes, volume, wireless remote, app controls, etc.

Cable tethered electronic link 28 is wirelessly connected to active electronic remote device 30 to allow for full remote operation and battery charging.

Integrated lighting ring 32 circumscribes housing 2 to transmit light above and below the water. Lighting ring 34 can be programmed to pulsate to music or play scenes. Ring float 34 optionally surrounds housing 2.

Replaceable, rechargeable battery 16 is located below the center of gravity of housing 2, in component chamber 14. This allows for self-righting when the speaker is thrown in the water. Weight distribution is carefully calculated and balanced for optimum floating height. Cradle 36 is provided for battery charging by means of 2-way wireless communication.

Underwater and/or wave pressure occupancy sensors 20 allow multiple functions. Pool alarm function is provided for personal safety should a child or unauthorized person enter the pool. A battery saver mode deactivates the underwater sound system for situations when there are no persons in the water, along with switching of lower transducer 10 from a water coupling mode to an air coupling optimized mode, for above water use. Additional integrated optional sensors include water temperature, pool water level (can trigger low water alarm or auto fill functions), chemical levels etc.

Wireless music streaming is accomplished via Bluetooth or 2-way Wi-Fi wireless methods along with solid state storage built into the unit. Wireless mesh mode allows multiple devices to be simultaneously linked and played together along with integration with above water sound systems. Speaker 1 has a UL676 rating for cable powered units in bodies of water occupied by people.

Optional mounts, accessories, and configurations include a drop-in, flush mount pool skimmer adapter 40 with self adjusting water height rod 42 for inserting into the device through hole 38 and side mount self adjusting water height pool mount 44.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An above and under the water speaker comprising:

a watertight, waterproof, sealed housing having a top section and a bottom section;

an upper transducer located within the top section of the housing, said transducer delivering sound solely through the air above a body of water;

a lower transducer located within the bottom section of the housing for delivering sound through the air above a body of water and through water under the surface of a body of water;

a compartment chamber located within the housing, between the upper and lower transducers, said chamber containing an electric battery; and a sound wave guide located on top of the housing to distribute sound from the upper transducer.

2. The speaker as in claim 1 wherein the chamber contains electronic sensors for deactivating the lower transducer and for switching the lower transducer from an under the water sound mode to and above the water sound mode.

3. The speaker as in claim 2 wherein the chamber contains electronic sensors for measuring water levels, chemical levels of water, and water temperature.

4. The speaker as in claim 1 wherein the battery is located below the center of gravity of the housing.

5. The speaker as in claim 1 wherein the chamber contains electronic sensors for measuring water levels, chemical levels in water, and water temperature.

6. The speaker as in claim 1 further comprising a lighting ring circumscribing the housing.

7. The speaker as in claim 1 further comprising a ring float surrounding the housing.

8. The speaker as in claim 1 further comprising an opening in the housing to accept a rod member for mounting the speaker to a pool wall.

* * * * *